US006405661B1

(12) United States Patent
Mancini et al.

(10) Patent No.: US 6,405,661 B1
(45) Date of Patent: Jun. 18, 2002

(54) COMBUSTION ENHANCING AIR FOIL

(75) Inventors: Rick A. Mancini, Endicott, NY (US); Nenad Sarunac, Easton, PA (US)

(73) Assignee: New York State Electric & Gas Corporation, Binghamton, NY (US)

( * ) Notice: Subject to any disclaimer, the term of this patent is extended or adjusted under 35 U.S.C. 154(b) by 0 days.

(21) Appl. No.: 09/813,966

(22) Filed: Mar. 22, 2001

(51) Int. Cl.[7] ..... F23H 3/00; F23H 1/02

(52) U.S. Cl. ..... 110/341; 110/298; 110/300; 110/311; 110/328; 110/341; 126/152 R; 126/163 R; 126/152 B

(58) Field of Search ..... 110/297, 298, 110/299, 300, 311, 328, 341; 126/152 R, 163 R, 155, 152 B

(56) References Cited

U.S. PATENT DOCUMENTS

| | | | | | |
|---|---|---|---|---|---|
| 362,648 | A | * | 5/1887 | Miller | 126/152 R |
| 1,456,521 | A | * | 5/1923 | Morris | 126/152 R |
| 1,602,030 | A | * | 10/1926 | Lansing | 126/152 R |
| 1,897,112 | A | * | 2/1933 | Courtney | 126/152 R |
| 2,967,496 | A | * | 1/1961 | Mitchell et al. | 110/38 |
| 3,014,439 | A | * | 12/1961 | Mitchell et al. | 110/174 |
| 3,321,845 | A | * | 5/1967 | Boron | 34/164 |
| 3,841,242 | A | * | 10/1974 | Sigg | 110/8 R |
| 4,385,567 | A | * | 5/1983 | Voss | 110/186 |
| 4,870,913 | A | * | 10/1989 | Schneider | 110/299 |
| 5,044,288 | A | * | 9/1991 | Barlow | 110/346 |
| 5,241,916 | A | * | 9/1993 | Martin | 110/348 |
| 6,213,031 | B1 | * | 4/2001 | Kunzil et al. | 110/341 |
| 6,290,493 | B1 | * | 9/2001 | Pirard et al. | 432/77 |

* cited by examiner

*Primary Examiner*—Ira S. Lazarus
*Assistant Examiner*—Kenneth B Rinehart
(74) *Attorney, Agent, or Firm*—Roylance, Abrams, Berdo & Goodman, L.L.P.

(57) ABSTRACT

A combustion enhancing member employed with a stoker combustion system is disposed on the grate of the stoker and includes at least one chamber. The chamber has at least one fluid inlet for receiving a combustion enhancing fluid and a plurality of fluid outlets for distributing the fluid to the bed of fuel moving along the grate of a stoker combustion system, thereby increasing the burning efficiency of the stoker.

30 Claims, 6 Drawing Sheets

COMBUSTION ENHANCING AIR FOIL

FIELD OF THE INVENTION

The present invention generally relates to a combustion enhancing system employed with a stoker for burning fuel. More specifically, the combustion enhancing system includes an air foil fixed to the moving grate of the stoker. The air foil provides non-aqueous combustion enhancing fluids to the bed of fuel traveling along the grate, thereby enhancing burning of the fuel and increasing the efficiency of the stoker.

BACKGROUND OF THE INVENTION

Stokers are employed for the mass burning of fuels. They generally function to feed fuel to a furnace combustion area, to distribute a supply of air to the fuel, and to retain the fuel until complete combustion is accomplished. Typically, the fuel is fed through the combustion area of the stoker by a moving or vibrating grate. The grates of conventional vibrating grate stokers are formed of a series of tuyers or keys, usually made of metal alloy or cast iron, which allow passage of combustion air through the underside of the grate to the fuel located on the top of the grate.

Efficiency of the stoker is measured by the completeness of the combustion of the fuel and the amount of pollutants resulting from that combustion. The type of fuel being burned also determines the stoker's efficiency. For example, coal is the typical fuel employed with a stoker and the more carbon in the coal that is burned the more efficient the stoker. Other fuels burned in conventional stokers are wood, and refuse materials or waste products.

However, conventional stokers fail to burn fuel, such as coal, efficiently, because the fuel travels through oxygen deficient zones in the combustion area of the stoker, resulting in incomplete fuel combustion. Also, the conventional stokers are inefficient because they do not account for impurities in the fuel, agglomerated fuel, or for encapsulation or swelling of the fuel where the fuel becomes resistant to the combustion air. An additional problem with conventional stokers is that they do not minimize pollutants resulting from the burning of the fuel.

Commonly owned U.S. Pat. No. 5,588,378 to Mancini entitled Combustion Enhancement System With In Bed Foils, addresses the above problems by employing a plurality of combustion enhancing air foils with a stoker having a conventional traveling belt type grate. The subject matter of U.S. Pat. No. 5,588,378 is herewith incorporated by reference. However, no prior art addresses the above problems with respect to stokers utilizing conventional moving grates other than traveling grates, such as vibrating or pusher type grates.

Examples of other prior art stokers are disclosed in the following U.S. Pat. Nos.: U.S. Pat. No. 697,620 to Green et al.; U.S. Pat. No. 3,152,562 to Cohen et al.; U. S. Pat. No. 4,510,873 to Shigaki; and U.S. Pat. No. 4,876,972 to Mrklas.

SUMMARY OF THE INVENTION

Accordingly, a general object of the present invention is to provide a combustion enhancing system that improves the fuel burning efficiency of a stoker.

Another general object of the present invention is to provide a combustion enhancing system that reduces the pollutants produced by the stoker.

A further object of the present invention is to provide a combustion enhancing system that includes an air foil for distributing a non-aqueous combustion fluid in an oxygen deficient zone of the stoker, thereby optimizing combustion of the fuel.

A yet further object of the present invention is to provide a combustion enhancing system that includes an air foil for distributing emission reducing agents, thereby reducing the pollutants produced by the stoker.

Another object of the present invention is to provide a combustion enhancing system that includes an air foil fixed to the grate of the stoker, with the grate being a vibrating stoker.

Still another object of the present invention is to provide a combustion enhancing system that includes an air foil fixed to the grate of the stoker, to facilitate breaking up of the fuel and thereby making the fuel less resistant to the combustion air of the stoker and exposing more surface area of the fuel for improved combustion.

Yet another object of the present invention is to provide a combustion enhancing system that includes an air foil that can be retro-fitted to existing stokers and is relatively easy to manufacture and install.

The foregoing objects can be basically attained by a combustion enhancing member for use in a stoker combustion system having a grate for supporting a bed of fuel, the combustion enhancing member comprising an inner wall portion defining a first chamber and a second chamber, the first chamber having a first fluid inlet for receiving a first fluid and at least one fluid outlet for ejecting the first fluid, and the second chamber having a second fluid inlet for receiving a second fluid; and an upper fuel engaging surface for engaging the bed of fuel, the fluid outlet being disposed in the upper fuel engaging surface allowing ejection of the first fluid in the direction of the bed of fuel.

The foregoing objects are also obtained by a stoker combustion system, comprising a grate having a support surface for supporting a bed of fuel; a first fluid supply system for supplying a combustion fluid to the support surface of the grate; a combustion enhancing member disposed on the support surface of the grate, the combustion enhancing member including a wall portion defining a first chamber, the first chamber having a first fluid inlet for receiving a first fluid and at least one fluid outlet for ejecting the first fluid, and a fuel engaging surface for engaging the bed of fuel, the fluid outlet being disposed in the fuel engaging surface allowing ejection of the first fluid in the direction of the bed of fuel; and a second fluid supply system for supplying the first fluid to the first fluid inlet of the combustion enhancing member.

The foregoing objects can also be obtained by a method of fitting a combustion enhancing member with a pre-existing stoker combustion system, the pre-existing stoker combustion system having a moving grate with a support surface for supporting a bed of fuel, and a first fluid supply system for providing combustion fluid to the bed of fuel, comprising the steps of providing a combustion enhancing member having a chamber with a fluid inlet for receiving a first fluid, and a fluid outlet for ejecting the first fluid, and a fuel engaging surface for supporting the bed of fuel; engaging the combustion enhancing member with the support surface of the grate; and supplying a pressurized fluid from a second fluid supply system to the bed of fuel through the fluid outlet of the combustion enhancing member.

Other objects, advantages and salient features of the invention will become apparent from the following detailed description which taken in conjunction with annexed drawings, discloses the preferred embodiments of the present invention.

BRIEF DESCRIPTION OF THE DRAWINGS

Referring to the drawings which form part of this original disclosure.

DETAILED DESCRIPTION OF THE INVENTION

Figure 1:
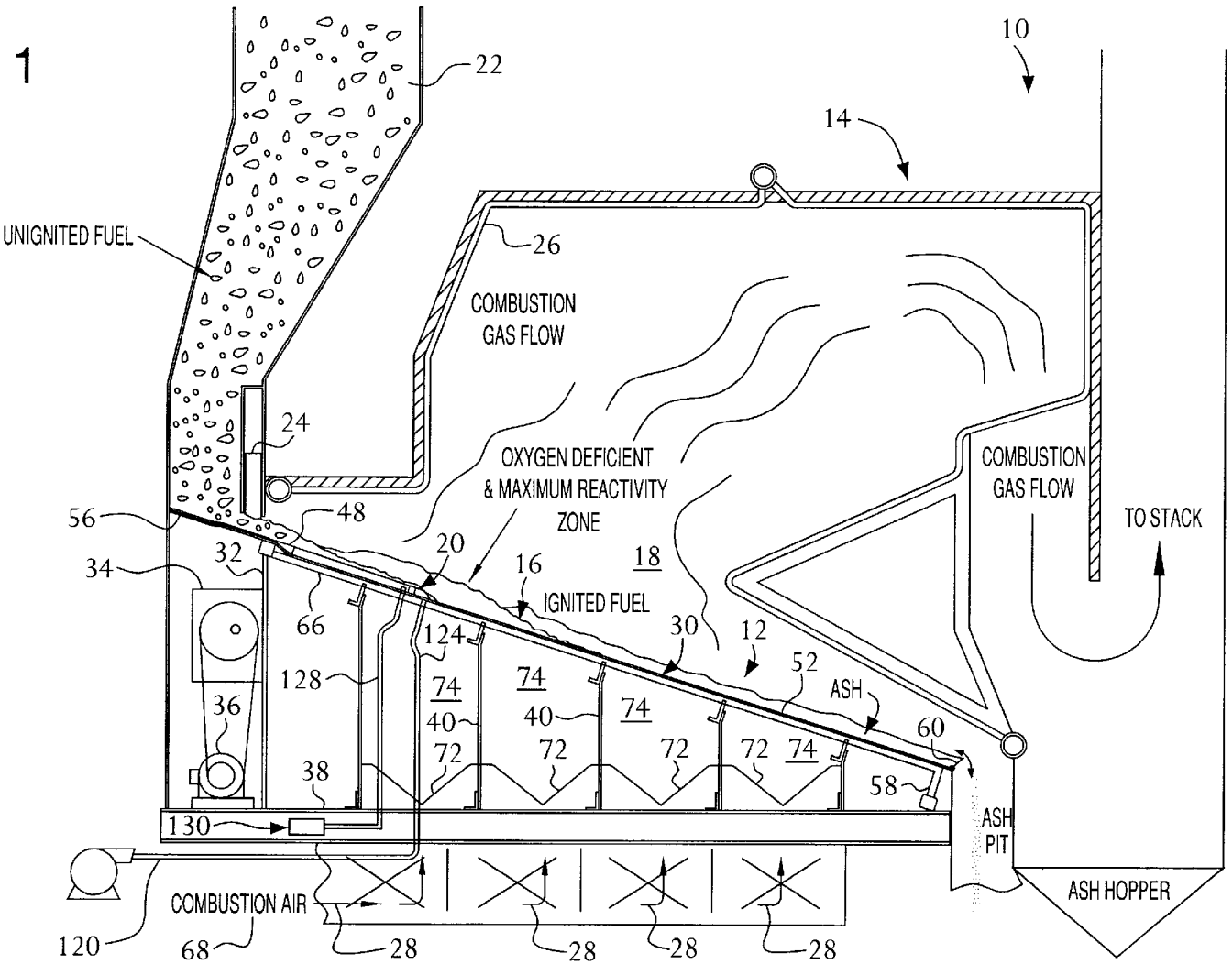
FIG. 1 is a schematic representation in section of a stoker with a vibrating grate utilizing an air foil in accordance with the first embodiment of the present invention.

Referring to FIG. 1, a stoker combustion system 10 in accordance with the present invention generally includes a grate assembly 12 and a furnace 14 with a bed of fuel 16 traveling down grate assembly 12 for combustion within a combustion area 18 of furnace 14. A combustion enhancing member or air foil 20 attached to grate assembly 12 increases the efficiency and amount of fuel being burned by providing a non-aqueous combustion fluid to the bed of fuel 16 in an oxygen deficient zone of furnace 14. Air foil 20 also acts to reduce pollution produced by stoker combustion system 10 by distributing emission reducing agents to the bed of fuel 16 while the fuel is being burned. Grate assembly 12 and furnace 14 are formed of any high temperature resistant material.

Grate assembly 12 and furnace 14 are conventional and therefore will be described only in sufficient detail to understand the present invention. The fuel 16 enters stoker system 10 through a fuel bunker 22 and onto grate assembly 12 via gravity with a gate 24 controlling the feed rate of the fuel 16, as best seen in FIG. 1. The bed of fuel 16 travels along grate assembly 12 through combustion area 18 of furnace 14 with a water wall and heat exchanger 26 defining the outer perimeter of furnace 14. Combustion fluid or air 28 provided through grate assembly 12 facilitates the burning of fuel 16.

In particular, the fuel 16 burns from top to bottom and becomes ash. However, with fuel, such as impure coal, encapsulation may occur where the coal swells and becomes resistant to the combustion air of the stoker resulting in inefficient and incomplete burning of the fuel. In addition, oxygen within particular areas of the fuel bed 16 depletes during the burning process, as seen in FIG. 1, also reducing the efficiency of stoker 10. Air foil 20 provides a combustion enhancing fluid, such as air, where oxygen has been consumed in areas of fuel bed 16. Oxygen enriched air can also be employed with air foil 20. Also, the force of the combustion enhancing fluid will break up any fuel that has swelled or agglomerated. In addition, air foil 20 provides a drop in the travel path of the fuel bed 16, which facilitates the break up of any swelled or agglomerated fuel. As a result, stoker 10 with air foil 20 burns fuel 16 more efficiently, and allows various fuels to be employed with stoker 10, whether impure or not. Moreover, materials that reduce emissions can be added to stoker 10 through air foil 20, thereby reducing pollution resulting from the burning of fuel 16.

Referring to FIGS. 1–5, grate assembly 12 specifically includes a slanted vibrating grate 30 connected to a frame 32, as is well known in the art. A grate eccentric shaker 34 and grate shaker motor drive 36 are attached to frame 32 and create the necessary movement or vibration to grate 30 for moving the bed of fuel 16 down grate 30. Motor 36 rests on base support 38 of frame 32 with flexible supports 40 extending between base support 38 and grate 30.

Figure 2:
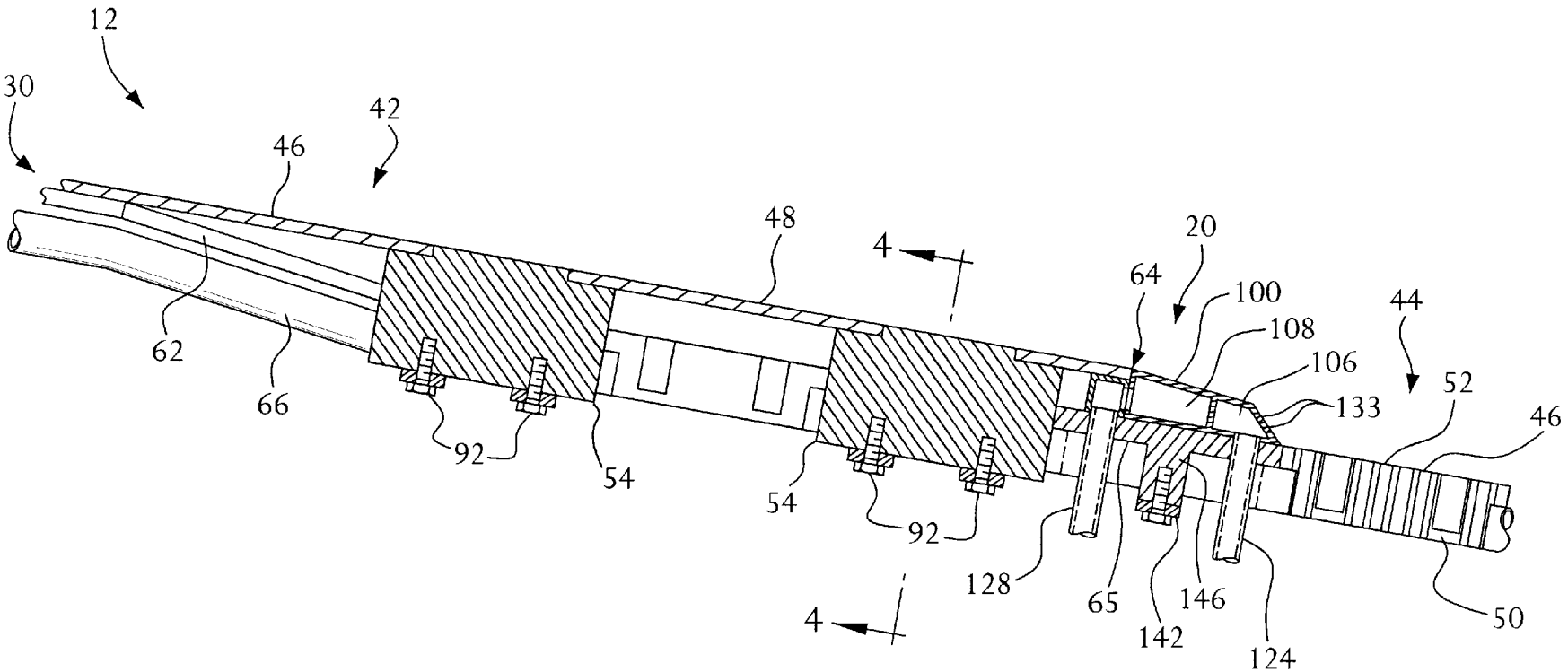
FIG. 2 is an enlarged elevational view of an air foil and a grate of the present invention illustrated in FIG. 1, showing the air foil fixed to the grate.
Figure 3:
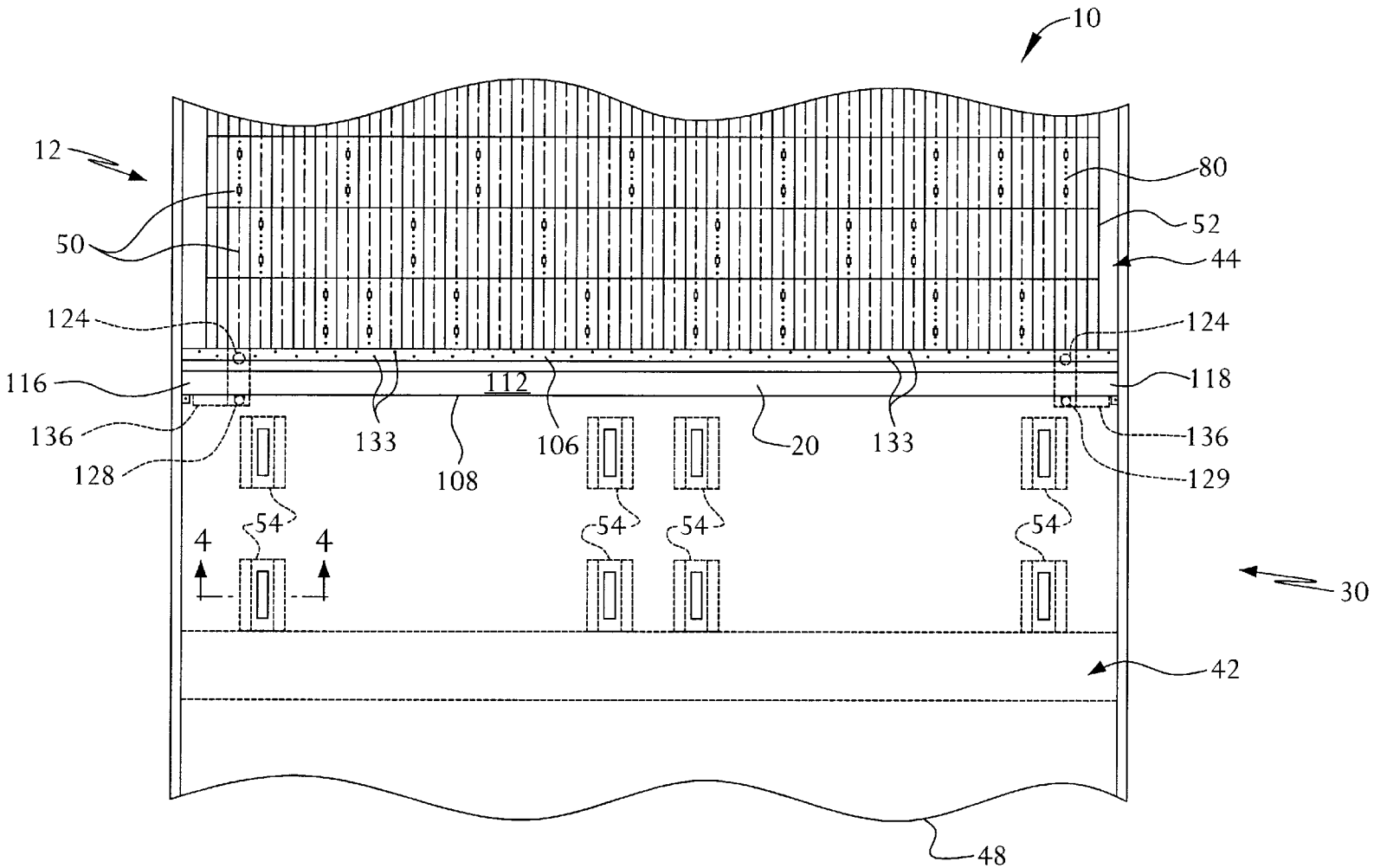
FIG. 3 is a top plan view of the air foil and the grate of the present invention illustrated in FIG. 1.

Grate 30 generally includes first and second sections 42 and 44 defining an upper support surface 46 for supporting the bed of fuel 16. First section 42 is a substantially planar plate 48 formed as a one-piece member extending across grate assembly 12. Second section 44 includes a plurality of tuyers 50 disposed adjacent one another and connected by fasteners, such as pins, forming a tuyer grate 52, as best seen in FIGS. 2 and 3. Plate 48 of first section 42 overlies tuyer grate 52 of second section 44 in a spaced relationship with a plurality of anchors 54 connecting the plate 48 to tuyer grate 52.

Figure 4:
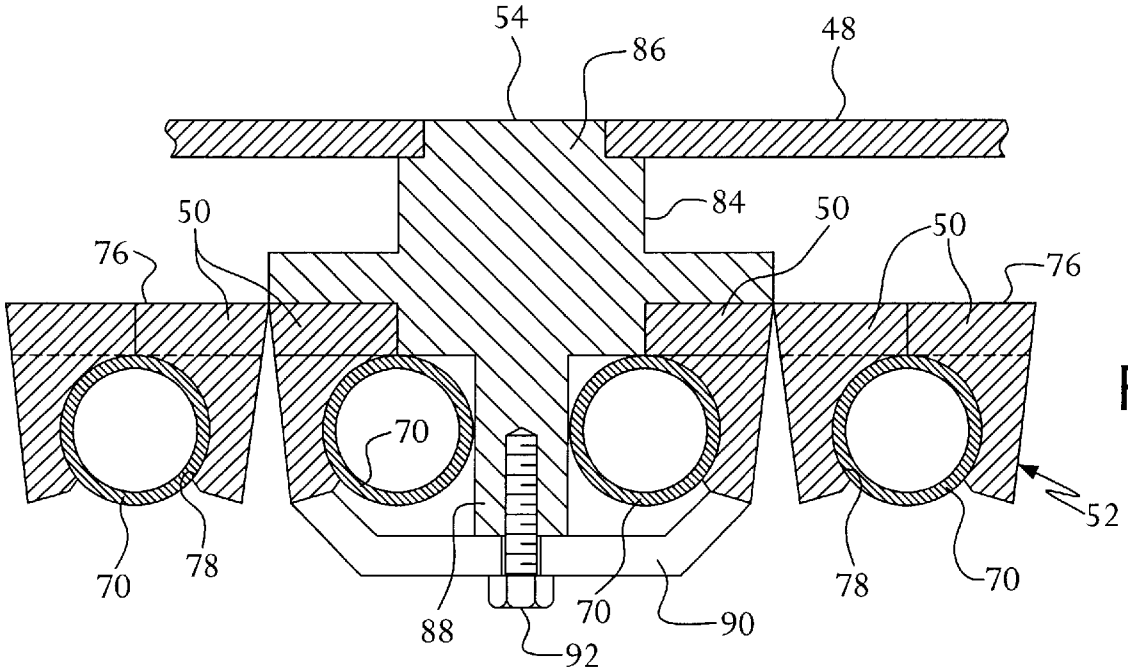
FIG. 4 is an enlarged, elevational view in section of the grate taken along line 4—4 of FIG. 2, showing a grate plate anchor and tuyers of the grate.

Plate 48 extends from a first end 56 of grate assembly 12 proximate fuel bunker 22 and ends or abuts with air foil 20. Tuyer grate 52 extends from first end 56 to a second end 58 of grate assembly 12 proximate an ash pit 60 of stoker 10. As seen in FIG. 2, grate 30 includes a downwardly slanted portion 62 below support surface 46 defining a space therebetween, and thereby creating a stepped portion 64 at the end of plate 48. Air foil 20 is disposed at stepped portion 64 with plate 48 abutting and being substantially flush with the top of air foil 20 and the bottom of air foil 20 resting on upper surface 46 at tuyer grate 52 so that the bed of fuel 16 can travel along upper support surface 46 and over air foil 20. Alternatively, for conventional grates that do not include a downwardly slanted portion 62 and are generally flat, stepped portion 64 can be created by adding an inclined plate disposed behind air foil 20 and over tuyer grate 52, thereby providing a ramp on which the fuel bed 16 can travel from the beginning of the grate to the top surface of air foil 20 and over air foil Grate assembly 12 also includes a grate cooling system 66 and a first fluid supply system 68, as is known in the art. As seen in FIG. 1, grate cooling system 66 comprising a plurality of piping members 70 extend underneath and the length of grate 30. As seen in FIG. 4, piping members 70 are disposed between tuyers 50 of tuyer grate 52. A cooling fluid such as water, is supplied to the members 70.

First fluid supply system 68 supplies combustion fluid 28, such as air, through registers 72 disposed between flexible supports 40 of frame 32 proximate base support 38 and through ducts 74 defined between flexible supports 40 to tuyer grate 52, as best seen in FIG. 1. A forced draft fan (not shown) is employed to pressurize the combustion air, as is known in the art.

Figure 5:
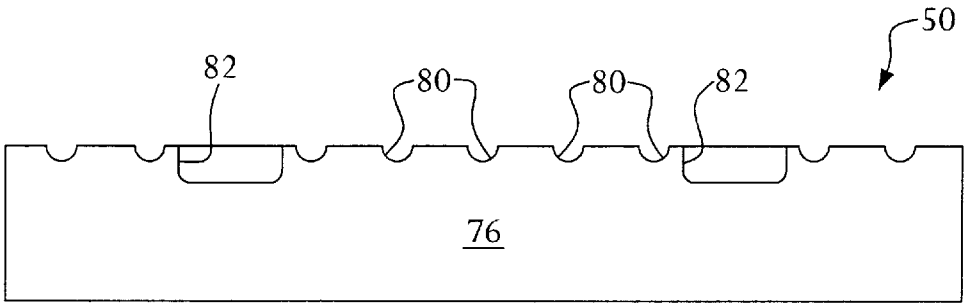
FIG. 5 is an enlarged, top plan view of a single tuyer of the grate of the present invention illustrated in FIG. 1.

As seen in FIGS. 4 and 5, each tuyer 50 has a substantially planar top surface 76 and lower cut-out portion 78 curved to accommodate piping members 70. A plurality of passageways 80 are disposed in one side of each tuyer 50 so that when more than one tuyer 50 is joined together, combustion fluid 28 from first fluid supply system 68 can be dispensed to and facilitate combustion of the bed of fuel 16 on grate 30 through passageways 80. A pin (not shown) is placed between adjacent tuyers 50 in a fastener slot 82 disposed in each tuyer 50, thereby securing tuyers 50 together to form tuyer grate 52. Each tuyer 50 of tuyer grate 52 is formed of cast iron blocks.

With respect to anchors 54 of grate assembly 12, each includes an anchor block 84 disposed between plate 48 and tuyer grate 52, as best seen in FIGS. 2–4. Preferably, anchor block 84 is a one-piece block but can be formed with separate plates that are integrally attached. Anchor block 84 includes top and bottom portions 86 and 88 with bottom portion 88 extending between tuyers 50 and attached to a bottom plate or clamp 90, positioned below anchor block 84, by bolts 92, thereby creating a frictional engagement between top portion 86 and tuyer grate 52. However, top portion 86 can be attached to tuyer grate 52 by fasteners (not shown), such as bolts.

Referring to FIGS. 1–3, and 6–7, air foil 20 is disposed on a sealing block 65 of grate 30 proximate stepped portion 64. Preferably, the optimal location of air foil 20 is dictated by the maximum oxygen deficient zone of the fuel bed 16. Through a series of tests or simulations of stoker 10 without air foil 20, the most oxygen deficient zone can be determined and thus the optimal location of air foil 20 can also be determined. As seen in FIG. 2, air foil 20 is located at stepped portion 64 where plate 48 terminates so that the bed of fuel 16 traveling along upper support surface 46 will tumble over air foil 20.

Air foil 20 generally includes a first or front wall portion 96 spaced from and opposing a second or rear wall portion 98, and a third or top wall portion 100 spaced from and opposing a fourth or bottom wall portion 102. Bottom wall portion 102 extends further than top wall portion 100 with front wall portion 96 extending from a distal end of bottom wall portion 102 to a distal end of top wall portion 100. Front wall portion 96 and bottom wall portion 102 define an acute angle therebetween with the outer or exterior surface 110 being sloped downwardly from top wall portion 100 to bottom wall portion 102 over which the bed of fuel 16 travels. Top wall portion 100 further defines an upper fuel engaging surface 112 that is substantially flush with plate 48. Bottom wall portion 102 further defines a lower grate engaging surface 114 that abuts support surface 46 at tuyer grate 52.

An inner wall portion 104 extends between and is substantially perpendicular to top and bottom wall portions 100 and 102 and is substantially parallel to rear wall portion 98. A first chamber 106 is defined between top and bottom wall portions 100 and 102, and inner wall portion 104 and front wall portion 96. Similarly, a second chamber 108 is defined between top and bottom wall portions 100 and 102, but between rear wall portion 98 and inner wall portion 104. Opposing end walls 116 and 118 close each end of first and second chambers 106 and 108 and air foil 20. Air foil 20 is preferably formed of a high temperature resistant material, such as stainless steel. The wall portions of air foil 20 are attached in a sealed or substantially sealed relationship, thereby generally preventing escape of any fluid therethrough.

Figure 7:
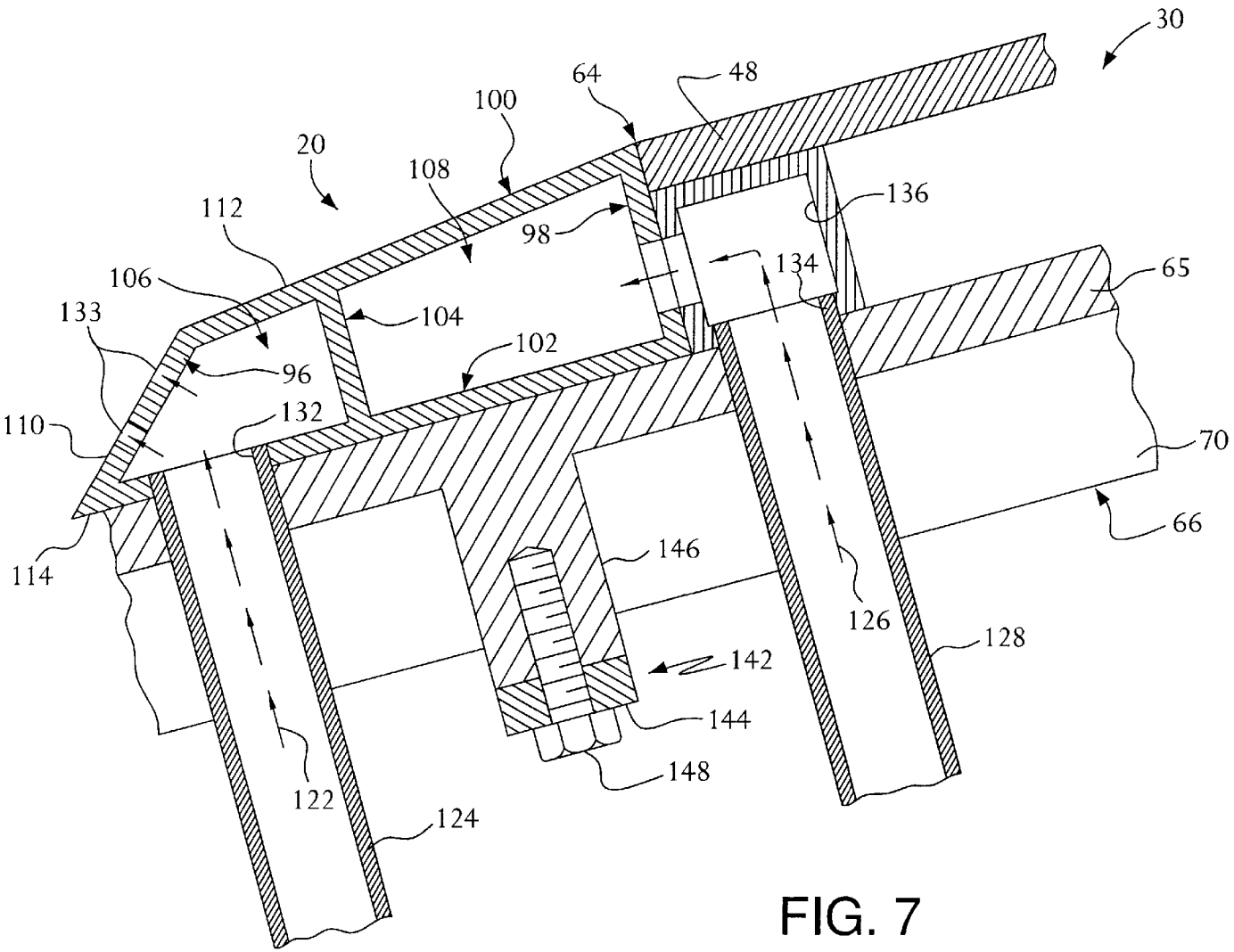
FIG. 7 is an enlarged, side elevational view in section of the air foil taken along line 7—7 of FIG. 6.

Preferably, as seen in FIG. 7, first chamber 106 has a generally trapezoidal cross-sectional shape and second chamber 108 has a generally square cross-sectional shape. However, either first or second chambers 106 and 108 can have various cross-sectional shapes such as generally triangular, square, or circular.

Proximate opposing end walls 116 and 118 of air foil 20, a second fluid supply system 120, independent from first fluid supply system 68, supplies a fluid 122 to first chamber 106 of air foil 20 through a first conduit member 124 located below grate 30, as best seen in FIGS. 1 and 3. In particular, fluid 122 is a non-aqueous combustion enhancing fluid including any gas, or gas combined with other gases, solids, or liquids (other than water), that contains a material or agent that increases the efficiency of combustion of the bed of fuel 16 and/or that reduces the emissions produced by the bed of fuel 16. Preferably, fluid 122 is air. Alternatively, fluid 122 can be oxygen enriched air, or air combined with emission reducing materials. Emission reducing materials preferably include any gas, liquid or solid having emission reducing chemicals. For example, emission reducing materials may include natural gas, magnesium oxide powder, or vaporized ammonium water solution.

Figure 6:
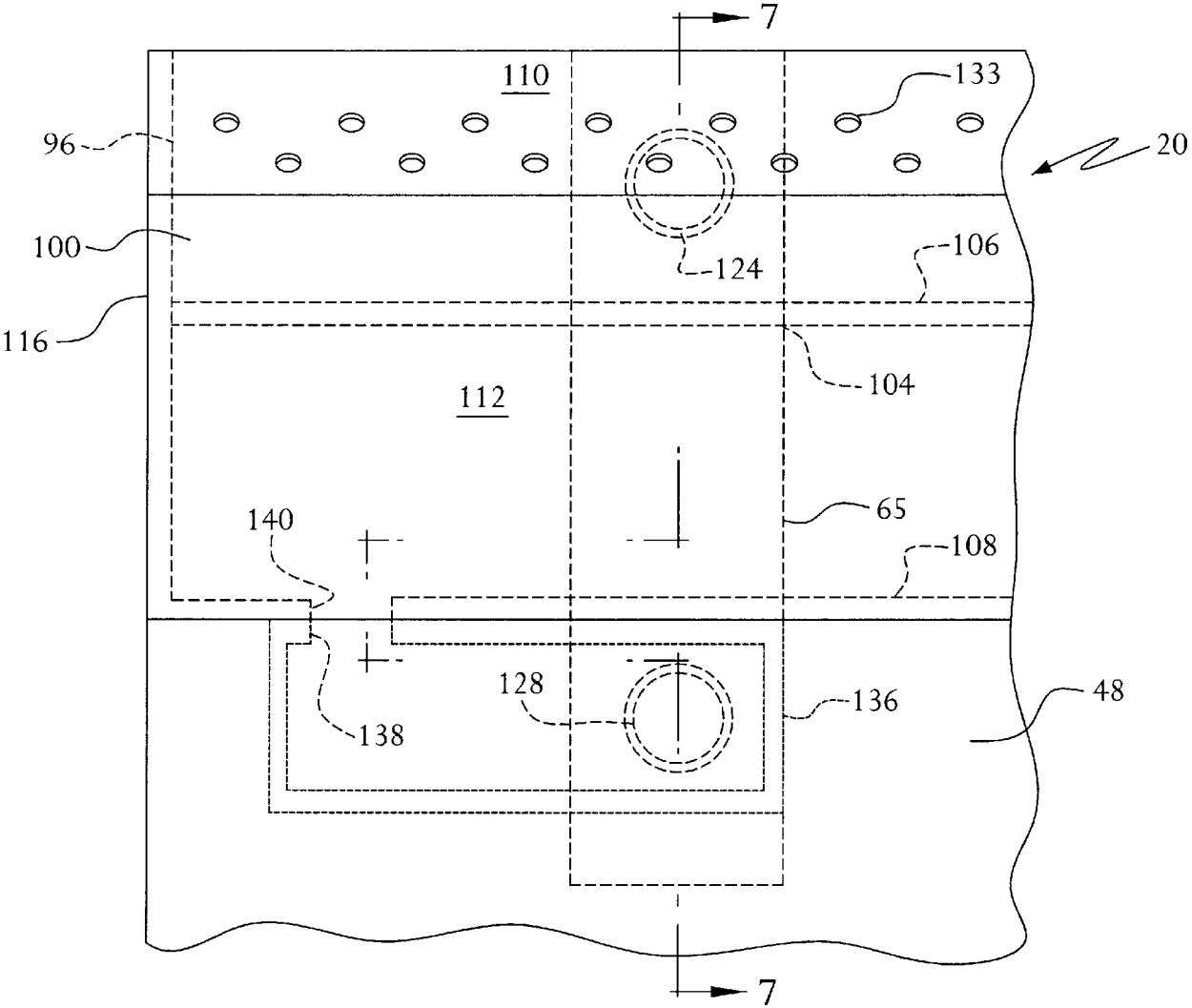
FIG. 6 is an enlarged, top plan view of the air foil of the present invention illustrated in FIG. 1.

Also at end walls 116 and 118, a cooling system 130, independent of grate cooling system 66, supplies a cooling fluid 126 to second chamber 108 of air foil 20 through a second conduit member 128, also located below grate 30, as seen in FIGS. 1 and 6. Cooling fluid 126 can be either a liquid or gas, such as water or air. Cooling system 130 maintains the structural stability of air foil 20. However, cooling system 130 and second chamber 108 of air foil 120 can be eliminated if stability of foil 20 can be maintained without cooling fluid 126 at lower temperature ranges of the stoker.

As seen in FIGS. 6 and 7, combustion fluid 122 is pressurized and piped to first chamber 106 of air foil 20 through first conduit members 124, each aligned with a first inlet or opening 132 disposed in bottom wall portion 102. A blower or small compressor (not shown) can be employed to pressurize fluid 122. A plurality of fluid outlets 133 disposed in front wall portion 96 allow fluid 122 to be distributed to the bed of fuel 16 traveling over downwardly sloping exterior surface 110 of air foil 20. Preferably, one conduit member 124 is located near one end 116 of air foil 20 and another conduit member 124 is located near the opposite end 118, as seen in FIG. 3. However, any number of first conduit members 124 can be used to supply fluid 122 to first chamber 106 along the length, defined between 116 and 118, of air foil 20. The number of conduit members 124 will depend on the desired amount and desired locations for dispersement of the combustion fluid 122 for the fuel bed 16.

Cooling fluid 126 is pressurized and piped to second chamber 108 of air foil 20 through second conduit members 128 and released through third conduit members 129. As seen in FIG. 3, preferably, at least one second conduit member 128 is located near one end 116 of air foil 20 and at least one third conduit member 129 is located near the opposite end 118. However, any number of second and third conduit members 128 and 129 can be used anywhere along the length of air foil 20 to supply cooling fluid 126 to second chamber 108 and release fluid 126 from second chamber 108, respectively.

Each second conduit member 128 is aligned with a first opening 134 in a rear compartment 136 disposed adjacent rear wall portion 98 of air foil 20 and between plate 48 and tuyer grate 52, as best seen in FIG. 7. A second inlet 140 disposed in rear wall portion 98 aligns with a second opening 138 of rear compartment 136, thereby providing fluid communication between rear compartment 136 and second chamber 108 of air foil 20. Each third conduit member 129 is substantially identical to second conduit members 128 in structure and connection to second chamber 108, except each third conduit member 129 allows fluid 126 to escape or release from second chamber 108.

Fluid 126, supplied through second conduit member 128, enters rear compartment 136 through first opening 134 and enters second chamber 108 of air foil 20 through second opening 138 and second fluid inlet 140. Fluid 126 can then escape through third conduit member 129. Alternatively, second and third conduit members 128 and 129 can be aligned directly with an opening in second chamber 108.

As seen in FIG. 7, first chamber 106 is substantially smaller than second chamber 108; however, the size and shape of first and second chambers 106 and 108 can vary as desired, by changing the location and orientation of inner wall portion 104. Testing and/or simulations conducted on stoker 10 would determine the required combustion fluid 122 and cooling fluid 126 needed for a particular stoker, thus determining the optimum sizes and shapes of each chamber. For example, with first chamber 106 being substantially smaller than second chamber 108, as seen in FIG. 7, more cooling fluid 126 is accommodated by air foil 20 than combustion enhancing fluid 122. However, first and second chambers 106 and 108 can be generally the same size, and first chamber 106 can be larger than second chamber 108 depending on conditions of stoker 10 which dictate whether more cooling fluid 126 is needed or more combustion enhancing fluid 122 is needed or the same amount of both fluids is required.

Also, inner wall portion 104 can be oriented in positions other than generally perpendicular to top and bottom wall portions 100 and 102. For example, inner wall portion 104 can be positioned diagonally between top and bottom wall portions 100 and 102, so that inner wall portion 104 extends either towards front wall portion 96 or rear wall portion 98, giving either first or second chambers 106 and 108 a generally triangular cross-sectional shape.

Also, if cooling fluid 126 is not needed, for example, if the structural integrity of the air foil 20 can be maintained without fluid 126, inner wall 104 can be eliminated, or an opening can be disposed in the inner wall, so that air foil 20 has generally one chamber for combustion fluid 122. In addition, a second inner wall can be added to either first or second chamber 106 and 108 to form a third chamber. Additional fluid outlets disposed in the top wall of the third chamber would allow a combustion fluid or an emission reducing agent, for example, to be supplied to fuel bed 16 through the third chamber.

Attachment of air foil 20 to grate 30 includes a welding attachment that secures air foil 20 to sealing block 65 and grate 30. Air foil anchors 142 each have an anchor plate 144 disposed below and attached to sealing block 65 at downwardly extending portions 146 with fasteners 148, such as bolts, further securing and clamping sealing block 65 and foil 20 to tuyer grate 52, as best seen in FIGS. 2 and 7. In addition, fasteners (not shown), such as bolts, can be employed to secure air foil 20 to grate 30, by extending the fasteners through front wall portion 96 of air foil 20 and through tuyer grate 52. Anchors 142 are employed along the longitudinal length of air foil 20 defined between its opposing end walls 116 and 118, with its longitudinal length being substantially equal to the entire width of grate 30.

Operation

In operation, foil 20 is attached to upper support surface 46 of grate 30 by anchors 142 at stepped portion 64 so that top wall portion 100 of air foil 20 is substantially flush with plate 48 of grate 30. The bed of fuel 16 enters furnace 14 through gate 24 onto grate 30 with movement or vibration from motor 36 coupled with gravity forcing the bed of fuel to travel down upper support surface 46 at plate 48 through combustion area 18. First fluid supply system 68 supplies combustion air 28 to combustion area 18 and to the bed of fuel 16 from beneath grate 30 and through tuyers 50, facilitating ignition of fuel 16.

Second fluid supply system 120 supplies combustion enhancing fluid 122 through outlets 133 of air foil 20 at or near the maximum oxygen deficient zone of the fuel. Fuel 16 travels over plate 48 to upper fuel engaging surface 112 and downwardly sloping exterior surface 110 of air foil 20 where fluid 122 can be dispersed into fuel 16 through outlets 133. Fluid 122 enhances combustion of fuel 16 by providing oxygen to oxygen depleted areas of furnace 14, thereby increasing the burning efficiency of stoker 10. Both the force of fluid 122 through outlets 133 and the drop from plate 48 to tuyer grate 52 over air foil 20 disrupts and breaks up fuel 16 for more efficient burning thereof. Also, emission reducing agents can be added to fluid 122 to reduce pollution resulting from the burning of fuel 16. The emission reducing agents are any gas, liquid, or solid that includes emission reducing qualities such as, natural gas, magnesium oxide powder, or vaporized ammonium oxide water solution. The type of agent employed depends on a variety of factors including the type of fuel being burned, the temperature, and type of stoker.

Preferably, emission reducing agents are added to combustion enhancing fluid 122 and dispersed to the fuel bed 16 with fluid 122. However, several other alternatives exist. First, another third chamber can be added to air foil 20 to accommodate the emission reducing agent. Second, first chamber 106 can be formed into two zones, by adding a second inner wall portion between front wall portion 96 and inner wall portion 104. The first zone would receive combustion fluid 122 and the second zone would receive the emission reducing agent. Finally, if air foil 20 can operate without cooling fluid 126, second chamber 108 can be used to accommodate the agent. In all cases, appropriate fluid outlets would have to be provided in top wall portion 100 to allow the agent to be disposed to the fuel bed 16.

Air foil 20 can be employed with newly constructed stokers or retrofitted to existing stokers. Air foil 20 can be used with various types of moving stokers including a vibrating grate stoker, or a pusher grate. Retro-fitting air foil 20 to an existing stoker merely requires following the steps described above including attaching air foil 20 to the grate of the existing stoker.

While particular embodiments have been chosen to illustrate the invention, it will be understood by those skilled in the art that various changes and modifications can be made therein without departing from the scope of the invention as defined in the appended claims.

What is claimed is:

1. A method of fitting a combustion enhancing member with a pre-existing stoker combustion system, the pre-existing stoker combustion system having a moving grate with a support surface for supporting a bed of fuel, and a first fluid supply system for providing a first combustion fluid to the bed of fuel, comprising the steps of:

providing a combustion enhancing member having a chamber with a fluid inlet for receiving a second fluid, and a fluid outlet for ejecting the second fluid, and a fuel engaging surface for supporting the bed of fuel;

engaging said combustion enhancing member with the support surface of the grate; and pressurizing the second fluid from a second fluid supply system to the bed of fuel through the fluid outlet of the combustion enhancing member.

2. A method of fitting a combustion enhancing member with a pre-existing stoker combustion system according to claim 1, further comprising the step of:

fixedly attaching the combustion enhancing member to the supporting surface of grate.

3. A method of fitting a combustion enhancing member with a pre-existing stoker combustion system according to claim 1, further comprising the step of:

supplying the second fluid from the second fluid supply system to an oxygen deficient zone in the bed of fuel.

4. A method of fitting a combustion enhancing member with a pre-existing stoker combustion system according to claim 1, wherein the second fluid supply system is separate from the first fluid supply system.

5. A method of fitting a combustion enhancing member with a pre-existing stoker combustion system according to claim 4, wherein the second fluid is oxygen enriched compressed air.

6. A stoker combustion system, comprising:

a grate having a support surface for supporting a bed of fuel;

a first fluid supply system for supplying a first combustion fluid to said support surface of said grate;

a combustion enhancing member disposed on said support surface of said grate, said combustion enhancing member including, a wall portion defining a first chamber, said first chamber having a first fluid inlet for receiving a second fluid and at least one fluid outlet for ejecting said second fluid, and a fuel engaging surface for engaging the bed of fuel, said fluid outlet being disposed in said fuel engaging surface allowing ejection of said second fluid in the direction of the bed of fuel; and a second fluid supply system for supplying said second fluid to said first fluid inlet of said combustion enhancing member.

7. A stoker combustion system according to claim 6, wherein said fuel engaging surface is an upper surface; and said combustion enhancing member includes a lower grate engaging surface opposite said upper fuel engaging surface engaging said support surface of said grate.

8. A stoker combustion system according to claim 6, wherein said wall portion of said combustion enhancing member is an inner wall portion and defines said first chamber and a second chamber, said second chamber includes a second fluid inlet.

9. A stoker combustion system according to claim 8, wherein said combustion enhancing member includes first and second opposing wall portions, said first chamber being defined between said first wall portion and said inner wall portion with said fluid outlet being disposed in said first wall, and said second chamber being defined between said second wall portion and said inner wall portion.

10. A stoker combustion system according to claim 9, wherein said grate includes a stepped portion between first and second sections of said grate; and said combustion enhancing member is disposed in said stepped portion;

said fuel engaging surface is substantially flush with said supporting surface of said grate at said first section; and said first wall portion includes a downwardly sloping exterior surface on which the bed of fuel drops from said first section of said grate to said second section of said grate, said second section being lower than said first section.

11. A stoker combustion system according to claim 9, wherein said combustion enhancing member includes third and fourth opposing wall portions;

each of said first, second, and inner wall portions, respectively, extends between said third wall portion and said fourth wall portion;

said fluid outlet being disposed on said first wall portion;

said fuel engaging surface being disposed on said first wall portion and said third wall portion;

said second fluid inlet being disposed in said second wall portion; and said first fluid inlet being disposed in said fourth wall.

12. A stoker combustion system according to claim 9, wherein said grate is a moving grate allowing the bed of fuel to travel along said support surface.

13. A stoker combustion system according to claim 9, wherein said first fluid supply system is separate and independent from said second fluid supply system.

14. A stoker combustion system according to claims 9, wherein said second fluid includes an emission controlling agent.

15. A stoker combustion system according to claim 9, wherein said second fluid includes a combustion enhancing fluid.

16. A stoker combustion system according to claim 15, wherein said combustion enhancing fluid is oxygen enriched compressed air.

17. A stoker combustion system according to claims 15, wherein a third fluid is provided to said second fluid inlet; and said third fluid is a cooling fluid.

18. A stoker combustion system according to claim 15, wherein said grate has a width; and said combustion enhancing member extends substantially across said width and is disposed in an oxygen deficient zone in the bed of fuel.

19. A combustion enhancing member for use in a stoker combustion system having a grate for supporting a bed of fuel, said combustion enhancing member comprising:

an inner wall portion defining a first chamber and a second chamber, said first chamber having a first fluid inlet for receiving a first fluid and at least one first fluid outlet for ejecting said first fluid, said second chamber having a second fluid inlet for receiving a second fluid, and said first and second chambers including a lower wall extending from said inner wall;

an upper fuel engaging surface for engaging the bed of fuel, said fluid outlet being disposed in said upper fuel engaging surface allowing ejection of said first fluid in the direction of the bed of fuel; and a lower grate engaging surface disposed on said lower wall and opposite said upper fuel engaging surface for engaging the grate.

20. A combustion enhancing member according to claim 19, further comprising first and second opposing wall portions;

said first chamber being defined between said first wall portion and said inner wall portion with said first fluid outlet being disposed in said first wall portion; and said second chamber being defined between said second wall portion and said inner wall portion.

21. A combustion enhancing member for use in a stoker combustion system having a grate for supporting a bed of fuel, said combustion enhancing member comprising:

an inner wall portion defining a first chamber and a second chamber, said first chamber having a first fluid inlet for receiving a first fluid and at least one first fluid outlet for ejecting said first fluid, and said second chamber having a second fluid inlet for receiving a second fluid;

an upper fuel engaging surface for engaging the bed of fuel, said fluid outlet being disposed in said upper fuel engaging surface allowing ejection of said first fluid in the direction of the bed of fuel;

a lower grate engaging surface opposite said upper fuel engaging surface for engaging the grate;

first and second opposing wall portions;

said first chamber being defined between said first wall portion and said inner wall portion with said first fluid outlet being disposed in said first wall portion;

said second chamber being defined between said second wall portion and said inner wall portion;

third and fourth opposing wall portions;

each of said first, second, and inner wall portions, respectively, extend between said third wall portion and said fourth wall portion;

said upper fuel engaging surface is disposed on said first wall portion and said third wall portion; and said lower grate engaging surface is disposed on said fourth wall portion.

22. A combustion enhancing member according to claim 21, wherein said first wall portion extends at an angle between said third and fourth wall portions, thereby defining a downwardly sloping exterior surface allowing the bed of fuel to drop from proximate said third wall portion to proximate said fourth wall portion.

23. A combustion enhancing member according to claim 22, wherein said second chamber includes a second fluid outlet for releasing said second fluid.

24. A combustion enhancing member according to claim 22, wherein said first chamber includes a third fluid inlet; and each of said first and third fluid inlets, respectively, is disposed in said fourth wall portion.

25. A combustion enhancing member according to claim 22, wherein said fluid outlet of said first chamber is a first fluid outlet; and said first chamber includes a second fluid outlet.

26. A combustion enhancing member according to claim 22, wherein said first fluid includes an emission controlling material.

27. A combustion enhancing member according to claim 22, wherein said first fluid includes a combustion enhancing fluid.

28. A combustion enhancing member according to claim 27, wherein said combustion enhancing fluid is air.

29. A combustion enhancing member according to claims 28, wherein said second fluid inlet is disposed in said second wall portion; and said second fluid is a cooling fluid.

30. A stoker combustion system, comprising:

a grate having a support surface for supporting a bed of fuel;

a combustion enhancing member disposed on said support surface of said grate, said combustion enhancing member including, an inner wall portion defining a first chamber and a second chamber, said first chamber having a first fluid inlet for receiving a first fluid and at least one fluid outlet for ejecting said first fluid, and said second chamber having a second fluid inlet for receiving a second fluid, an upper fuel engaging surface for engaging the bed of fuel, said fluid outlet being disposed on said upper fuel engaging surface allowing ejection of said first fluid in the direction of the bed of fuel, and a lower grate engaging surface opposite said upper fuel engaging surface engaged with said support surface of said grate;

said grate includes a stepped portion; and said combustion enhancing member is disposed in said stepped portion with said upper fuel engaging surface being flush with a section of said support surface of said grate.

* * * * *